US010640912B2

(12) United States Patent
Ramirez et al.

(10) Patent No.: US 10,640,912 B2
(45) Date of Patent: May 5, 2020

(54) ACCESSORY FOR A STEAMING DEVICE

(71) Applicant: KONINKLIJKE PHILIPS N.V., Eindhoven (NL)

(72) Inventors: Rico Paolo Ochoa Ramirez, Eindhoven (NL); Kai Heng Kwok, Eindhoven (NL); Mohankumar Valiyambath Krishnan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/504,128

(22) PCT Filed: Aug. 21, 2015

(86) PCT No.: PCT/EP2015/069288
§ 371 (c)(1),
(2) Date: Feb. 15, 2017

(87) PCT Pub. No.: WO2016/030299
PCT Pub. Date: Mar. 3, 2016

(65) Prior Publication Data

US 2017/0275812 A1 Sep. 28, 2017

(30) Foreign Application Priority Data

Aug. 26, 2014 (EP) ..... 14182180

(51) Int. Cl.
*D06F 79/02* (2006.01)
*D06F 79/00* (2006.01)

(52) U.S. Cl.
CPC ..... *D06F 79/02* (2013.01); *D06F 79/00* (2013.01)

(58) Field of Classification Search
CPC ..... D06F 75/32; D06F 75/36; D06F 75/38; D06F 75/40
USPC ..... 38/141, 142, 1 A
See application file for complete search history.

(56) References Cited

U.S. PATENT DOCUMENTS 2,299,202 A * 10/1942 Bass ..... D06F 75/38 38/141
3,318,029 A * 5/1967 Jacobson ..... D06F 75/38 156/253
3,428,280 A 2/1969 Brandt
3,905,138 A * 9/1975 Abolafia ..... D06F 75/38 38/97
5,414,945 A * 5/1995 Freeman ..... D06F 79/02 219/259
8,375,612 B2 * 2/2013 Talip ..... D06F 79/00 219/259

(Continued)

FOREIGN PATENT DOCUMENTS

DE 3605429 A1 8/1987
DE 102010014727 A1 10/2011

(Continued)

*Primary Examiner* — Nathan E Durham

(57) ABSTRACT

The present application relates to an accessory (1) for a steaming device (2) comprising a tray to receive a sole plate (6) of a steaming device during a cleaning cycle so that steam and/or scale is directed into said tray, the tray having an opening (14) so that when a sole plate of a steaming device is received on the tray, steam can egress out of the tray in a direction away from said steaming device through said opening.

12 Claims, 2 Drawing Sheets

(56) References Cited

U.S. PATENT DOCUMENTS

| | | | |
|---|---|---|---|
| 2003/0136032 | A1 | 7/2003 | Leung |
| 2012/0017475 | A1 | 1/2012 | Adams |

FOREIGN PATENT DOCUMENTS

| | | | |
|---|---|---|---|
| EP | 0953670 | A1 | 11/1999 |
| JP | 5825200 | A | 2/1983 |
| JP | 2002282600 | A | 10/2002 |
| KR | 20110127834 | A | 11/2011 |

* cited by examiner

ACCESSORY FOR A STEAMING DEVICE

This application is the U.S. National Phase application under 35 U.S.C. § 371 of International Application No. PCT/EP2015/069288, filed on Aug. 21, 2015, which claims the benefit of International Application No. 14182180.1 filed on Aug. 26, 2014. These applications are hereby incorporated by reference herein.

FIELD OF THE INVENTION

The present invention relates to an accessory for a steaming device, for instance a steam iron or a garment steamer. It also relates to a steaming device comprising the accessory of the invention and to a method of cleaning a steaming device using the accessory of the invention.

BACKGROUND OF THE INVENTION

A steam iron has a housing incorporating a handle, a heel on which the iron rests when not in use, and a heated soleplate to remove creases from clothes. A steam iron also has a reservoir to contain water which is supplied to a steam generator to generate steam which is ejected through steam distribution openings in the soleplate onto clothes as they are ironed to assist with crease removal.

After a period of use, conventional calcified deposits, commonly called 'scale', is formed in the steam generator as a result of the steam generation process, especially when the water being used to generate steam is hard. Many steam irons have a cleaning cycle or function in which the heater is heated to a high predetermined temperature and a large quantity of water is rapidly fed to the steam generator at once. This results in a lot of steam being generated in a short space of time which is ejected through the openings in the sole plate. As the jets of steam resulting from this rapid heating of a large amount of water can be quite powerful, they entrain particles of scale deposited within the steam generator and carry them out of the iron through the holes in the sole plate, thereby cleaning the steam generator and unblocking the openings in the sole plate.

A disadvantage with the cleaning cycle is that a user generally needs to hold the iron carefully so as to ensure that they, anyone else, furniture or goods that may be damaged by excessive steam will not be in the path of the jets. The scale entrained in the steam must also be cleaned up from any surfaces on which it lands. Furthermore, the iron may be at least partially enveloped by the steam, which can potentially cause some discomfort to the user. The weight of the iron and the length of the cleaning cycle may also be problematic for some users, who may find it difficult to hold the iron for the duration of the cleaning cycle.

As well as the potential danger caused by the steam enveloping the iron, the steam can also cause condensation to form on the housing and other components, which is undesirable.

A holder that is used to support a steam iron during periods of non-use is known from US2012/0017475 A1. The holder collects water spilt from a water reservoir fill-inlet of a steam iron received in the holder in the event that it is tipped up or dropped. Small amounts of steam and water that continue to be ejected from the sole plate after it has been switched off and placed in the holder pass through holes in a padded layer supporting the sole plate of the iron. However, the holder is not designed to enable a steam iron to undergo a cleaning cycle whilst in the holder and there is no opening for the egress of steam from the holder.

SUMMARY OF THE INVENTION

It is an object of the invention to provide an accessory for a steaming device which substantially alleviates or overcomes the problems mentioned above.

The invention is defined by the independent claims; the dependent claims define advantageous embodiments.

According to the present invention, there is provided an accessory for a steaming device comprising a tray to receive a sole plate of a steaming device during a cleaning cycle so that steam, water and/or scale is directed into said tray, the tray having an opening so that when a sole plate of a steaming device is received on the tray, steam can egress of steam out of the tray in a direction away from said steaming device through said opening.

As the steaming device is placed in the accessory in order to carry out a cleaning cycle, there is no need for a person to hold the steaming device whilst the cleaning cycle is in progress. Furthermore, the steam is directed into the tray and any scale deposits and condensed water are collected in the tray for subsequent disposal. The opening also directs steam away from the steaming device and therefore prevents condensation and heat build-up on the housing and other components.

Preferably, the tray has a base and a supporting surface to receive and support a sole plate of a steaming device in a position above the base.

The tray supports the sole plate of the steam generator above the base so that there is a space within the tray to receive the steam, to collect water without immersing the sole plate and to collect scale ejected from the device.

The supporting surface may lie in a plane that extends at an angle relative to a plane occupied by the base. This means that the steaming device is supported in an orientation which is different to the usual orientation that the steaming device assumes during normal use. A switch or orientation sensor may be used to detect when the iron is positioned on the tray by its orientation and then a cleaning cycle may be automatically initiated, possibly after the steaming device has remained in that orientation for a predetermined period of time.

The supporting surface may define the periphery of an aperture in the tray and is configured to contact a portion of a sole plate received thereon so that steam distribution holes in the sole plate are not obstructed by said supporting surface and the steam is free to enter the tray from the steam distribution holes through the aperture, together with any scale entrained in the steam. In particular, as the sole plate only contacts the tray close to its peripheral edge, a major area of the sole plate is free and out of contact with the tray. Steam ejected through steam distribution holes in the sole plate may therefore escape into the tray unencumbered by any part of the accessory.

The supporting surface can be configured so that it makes contact with the entire circumference of a peripheral edge of a sole plate.

As the supporting surface contacts a sole plate around its entire edge, the exit of steam from between the supporting surface and the sole plate can be minimised or prevented, such that all, or most, of the steam will escape from the opening provided in the tray.

In a preferred embodiment, the accessory comprises a guide wall to guide a sole plate towards the supporting surface.

The guide wall helps to direct a sole plate into position on the supporting surface as it is lowered onto the tray.

An inwardly facing surface of the guide wall may be curved in shape.

The curved shape further assists in guiding the sole plate to ensure its correct positioning on the supporting surface.

In some embodiments, a resilient sealing member may be provided on the supporting surface to form a seal between the periphery of the sole plate and the supporting surface.

A resilient sealing member can improve the seal between the sole plate and the tray to further prevent the egress of steam out of the tray from any gaps between the sole plate and the supporting surface.

Preferably, the tray has a region that extends beyond the supporting surface and the opening is provided in said region. Steam may exit the tray through the opening in this region.

The opening may be angled to direct steam exiting from the tray through the opening and in a direction away from a steaming device received on said supporting surface. This ensures that the steaming device is not heated by the steam and that no condensation forms on the surface of the steaming device.

In a preferred embodiment, a side wall extends upwardly from the base, said wall being at an angle in the region of 98 to 105 degrees relative to the base. This ensures that steam is directed away from the steaming device but also ensures that water does not gush out of the opening.

Preferably, the tray comprises a laterally outward extending flange. The flange forms a handle to enable the tray to be carried more easily, especially when it is full of water. The flange may be in sections extending about the periphery of the tray.

A rib may upstand from the base of the tray towards the supporting surface. The rib can be integrally formed from the base and serves to prevent water from sloshing around within the tray when, for example, it is being carried.

According to another aspect of the invention, there is provided a steaming device, such as a steam iron, having a sole plate and comprising an accessory according to the invention.

According to another aspect of the invention, there is provided a method of cleaning a steaming device having a sole plate, the method comprising the step of placing said sole plate in an accessory comprising a tray to receive said sole plate, and initiating a cleaning cycle so that steam and/or scale is directed into said accessory and so that steam exits through an opening in the tray in a direction away from said steaming device.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
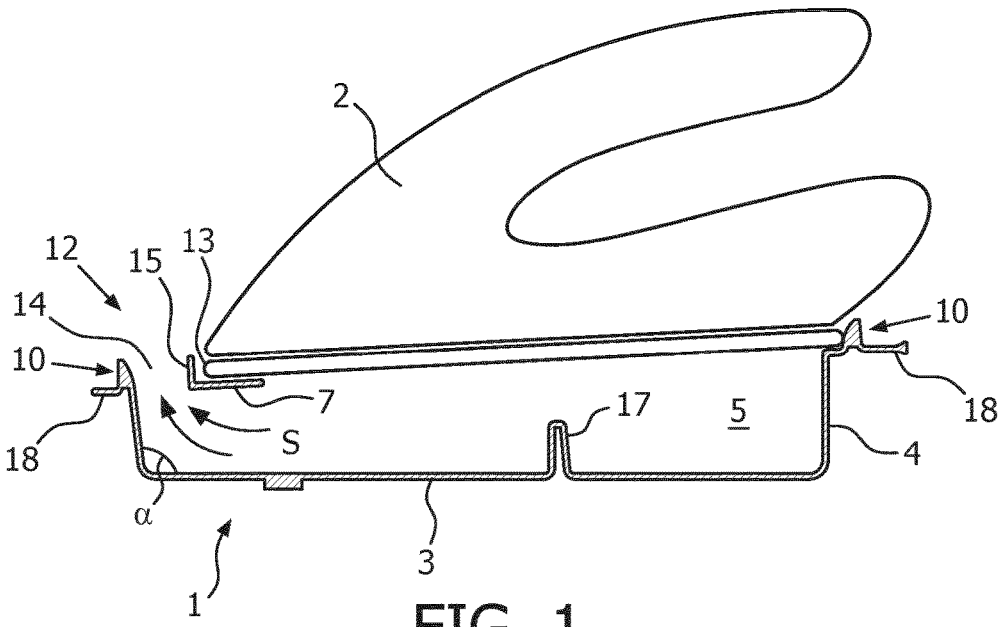
FIG. 1 shows a cross-sectional side view of an accessory for a steaming device according to an embodiment of the invention, with a steam iron positioned thereon.
Figure 2:
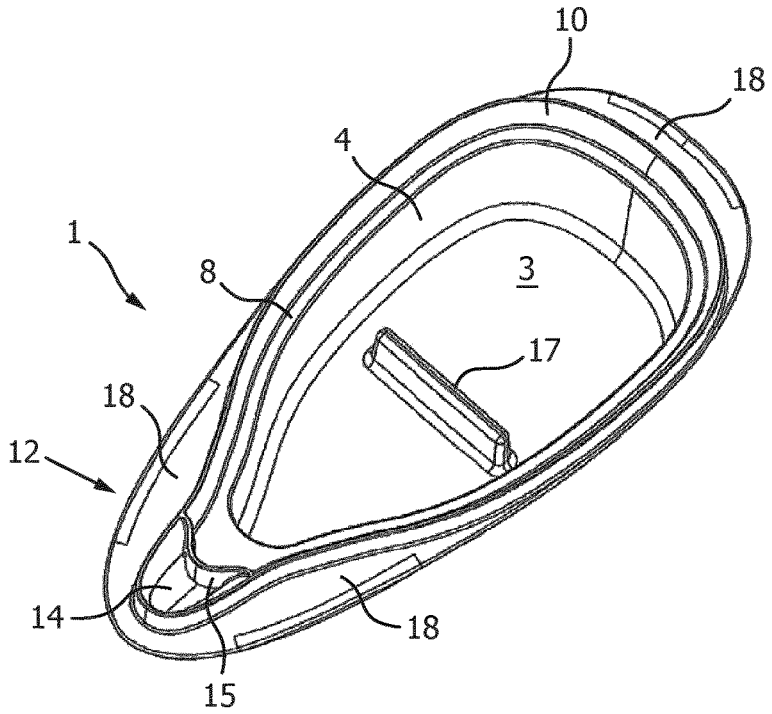
FIG. 2 shows a perspective view of the accessory shown in FIG. 1.

With reference to the drawings, there is shown in FIGS. 1 and 2, an accessory 1 for a steaming device such as a steam iron 2. The accessory 1 comprises a tray having a base 3 and a side wall 4 that extends upwardly from around the periphery of the base 3 to form a recess or bath 5 for the collection of scale deposits and water from the steam iron 2 during a cleaning cycle.

Figure 3:
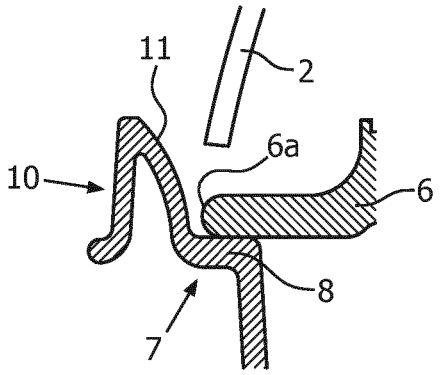
FIG. 3 shows a cross-sectional view to show how the steam iron is supported on the accessory.

As shown in FIG. 1, steam iron 2 is placed on the tray so that its sole plate 6 is spaced from the base 3. The tray has a seat 7 to support the steam iron 2 thereon. As shown in FIG. 3, the seat 7 may comprise a supporting surface 8 extending laterally inwardly from an upper end of the side wall 4. Preferably, the supporting surface 8 is shaped and continuous so that the sole plate 6 of the steam generator 2 will make contact with it around its entire periphery to prevent the egress of steam from around the edge of the sole plate 6. It will be appreciated that the supporting surface 8 defines a single aperture in the tray to receive the sole plate 6 and that only a very small region extending inwardly from the peripheral edge 6*a* of the sole plate 6 lies in contact with the supporting surface 8. This ensures that the majority of the surface area of the sole plate 6 does not make contact with any part of the tray and that it is only supported at its outermost edge without any steam distribution holes in the sole plate becoming blocked by the tray.

As shown in FIG. 3, the sole plate 6 of the steam iron 2 may lie in direct contact with the supporting surface 8 and the weight of the steam iron 2 pressing against the supporting surface 8 is sufficient to provide an adequate seal between the supporting surface 8 and the sole plate 6. However, in a preferred embodiment, the sole plate 6 rests on a resilient sealing member 9 attached to the supporting surface 8, which deforms slightly under the weight of the steam iron 2, thereby improving the seal between the sole plate 6 and the supporting surface 8 and preventing egress of steam from the tray between the sole plate 6 and the supporting surface 8.

Figure 4:
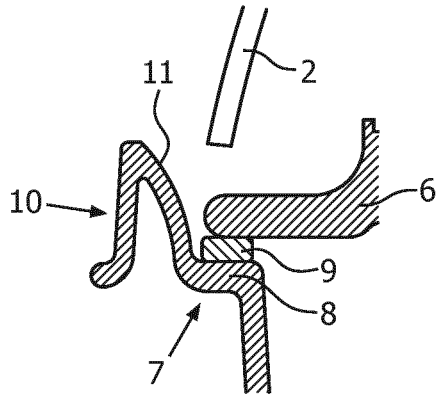
FIG. 4 shows a cross-sectional view to show how the steam iron is supported on the accessory according to an alternative embodiment.

The supporting surface 8 includes an upstanding guide wall 10. As shown in FIGS. 3 and 4, an inwardly facing surface 11 of the guide wall 10 may be curved to assist in guiding the sole plate 6 into position on the supporting surface 8 when the steam iron 2 is lowered onto the tray.

The accessory 1 has an elongated nose section 12 that extends beyond the supporting surface 8 directly in front of where the tip 13 of the sole plate 6 of a steam iron 2 positioned on the tray would be located. An opening 14 is formed in the nose section 12 for the egress of steam from the tray through the opening 14. The opening 14, or at least the side wall 4, may be angled so that the steam is directed away from a steam iron 2 seated on the tray. In particular, the side wall 4 may extend upwardly and outwardly from the base 3 at an angle in the region of between 98 to 105 degrees from the base 3 (as indicated by angle a in FIG. 1) so as to direct steam out of the tray and away from the steaming device. At angles less than 98 degrees, steam is more likely to be directed towards the steaming device whereas, at angles greater than 105 degrees, water may gush out of the opening 14.

The supporting surface 8 forms a bridge that extends between opposite facing surfaces of the side wall 4 of the tray under which steam can pass to reach the opening 14, i.e. in the direction of arrows 'S' in FIG. 1. An edge of the supporting surface 8 forming the bridge has an upstanding lip 15 to separate the supporting surface 8 from the opening 14.

It will be appreciated that a plane occupied by the supporting surface 8 is angled relative to a plane occupied by the base 3, with the lowest point of the supporting surface 8 adjacent to the opening 14. The supporting surface 8 may lie at an angle in the region of 3 degrees relative to the base 3. When the base 3 of the tray is resting on a flat, horizontal surface, the iron is held at an angle within the tray, and so is in a different position than the position it would normally be in for ironing. In some embodiments, the steaming device may incorporate a position or orientation sensor so that it 'knows' whether it has been placed on the tray. The cleaning cycle may then initiate only once it is in this position or after it has remained in this position for a period of time. Alternatively, a user may operate a switch on the steaming device to begin a cleaning cycle which will only start once the steaming device is in a particular position, i.e. when it has been placed on the tray. It will be appreciated that this provides an additional safety feature because the user must place the steaming device on the tray and let go of it completely prior to initiation of the cleaning cycle.

In other variants, the steaming device and/or the iron may incorprate a proximity sensor or switch that is activated only once the steaming device has been correctly positioned on the tray, thereby enabling a cleaning cycle to commence.

The height of the side wall 4 of the tray is selected so that, after a cleaning cycle has been completed, the depth of water collected in the tray will not reach the lowest point of the supporting surface 8 and, preferably, the distance between the supporting surface 8 and the level of the water will not be less than 13 mm.

A rib 17 upstands from the base 3 of the tray to help prevent water contained in the tray from moving around as the tray is carried to a position where it is to be emptied after a cleaning cycle is complete.

The outer most edge of the tray has a laterally protruding flange 18 to enable the tray to be carried more easily when it contains water.

The tray may be molded from a high temperature resistant plastics material. It may also be a unitary component.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. An accessory for a steaming device comprising:

a tray to receive a sole plate of a steaming device during a cleaning cycle, the tray being configured to receive steam, water and/or scale directed into said tray from said sole plate, the tray having an opening to allow said steam to egress out of said tray opening in a direction away from said steaming device when the sole plate of the steaming device is received on the tray, the tray having a base and a supporting surface to receive and support said sole plate of the steaming device in a position above the base, wherein the supporting surface defines the periphery of an aperture in the tray, the supporting surface being configured to contact the entire circumference of a peripheral edge of the sole plate received on the supporting surface, wherein the accessory has an elongated nose section that extends beyond the supporting surface directly in front of a tip of the sole plate of the steam iron positioned on the tray in a typical orientation that the steaming device assumes during normal use, wherein said opening is formed in the nose section to allow egress of steam from the tray through the opening, wherein a side wall extends upwardly from the base, wherein the supporting surface extends laterally from an upper end of the side wall, and wherein a majority of the surface area of the sole plate does not make contact with the tray.

2. An accessory according to claim 1, wherein the supporting surface lies in a plane that extends at an angle relative to a plane occupied by the base.

3. An accessory according to claim 1, comprising a guide wall to guide a sole plate towards the supporting surface.

4. An accessory according to claim 3, wherein an inwardly facing surface of the guide wall is curved in shape.

5. An accessory according to claim 1, comprising a resilient sealing member on the supporting surface to form a seal between the periphery of the sole plate and the supporting surface.

6. An accessory according to claim 1, wherein the tray has a region that extends beyond the supporting surface, said opening being provided in said region.

7. An accessory according to claim 6, wherein the opening is configured to direct steam exiting from the tray through the opening in a direction away from the steaming device received on said supporting surface.

8. An accessory according to claim 7, wherein said side wall is at an angle between 98 to 105 degrees relative to the base.

9. An accessory according to claim 1, comprising a flange extending in a laterally outward direction to form a handle for carrying the tray.

10. An accessory according to claim 1, wherein a rib upstands from the base of the tray towards the supporting surface.

11. A steaming device, having a sole plate and comprising an accessory comprising:

a tray to receive a sole plate of a steaming device during a cleaning cycle, the tray being configured to receive steam, water and/or scale directed into said tray from said sole plate, the tray having an opening to allow said steam to egress out of said tray opening in a direction away from said steaming device when the sole plate of the steaming device is received on the tray, the tray having a base and a supporting surface to receive and support said sole plate of the steaming device in a position above the base, wherein the supporting surface defines the periphery of an aperture in the tray, the supporting surface being configured to contact the entire circumference of a peripheral edge of the sole plate received on the supporting surface wherein the accessory has an elongated nose section that extends beyond the supporting surface directly in front of a tip of the sole plate of the steam iron positioned on the tray in a typical orientation that the steaming device assumes during normal use, wherein said opening is formed in the nose section to allow egress of steam from the tray through the opening, wherein a side wall extends upwardly from the base, wherein the supporting surface extends laterally from an upper end of the side wall, and wherein a majority of the surface area of the sole plate does not make contact with the tray.

12. A steam iron having a sole plate and comprising an accessory comprising:

a tray to receive a sole plate of a steaming device during a cleaning cycle, the tray being configured to receive steam, water and/or scale directed into said tray from said sole plate, the tray having an opening to allow said steam to egress out of said tray opening in a direction away from said steaming device when the sole plate of the steaming device is received on the tray, the tray having a base and a supporting surface to receive and support said sole plate of the steaming device in a position above the base, wherein the supporting surface defines the periphery of an aperture in the tray, the supporting surface being configured to contact the entire circumference of a peripheral edge of the sole plate received on the supporting surface wherein the accessory has an elongated nose section that extends beyond the supporting surface directly in front of a tip of the sole plate of the steam iron positioned on the tray in a typical orientation that the steaming device assumes during normal use, wherein said opening is formed in the nose section to allow egress of steam from the tray through the opening, wherein a side wall extends upwardly from the base, wherein the supporting surface extends laterally from an upper end of the side wall, and wherein a majority of the surface area of the sole plate does not make contact with the tray.

* * * * *